US007461674B2

(12) United States Patent
Kameoka et al.

(10) Patent No.: US 7,461,674 B2
(45) Date of Patent: Dec. 9, 2008

(54) WORKSTATION FOR PREPARING DOOR ELEMENTS FOR HANGING

(75) Inventors: George Y. Kameoka, Petaluma, CA (US); Jerry A. Kvalheim, Petaluma, CA (US)

(73) Assignee: Kval, Inc., Petaluma, CA (US)

( * ) Notice: Subject to any disclaimer, the term of this patent is extended or adjusted under 35 U.S.C. 154(b) by 460 days.

(21) Appl. No.: 11/078,604

(22) Filed: Mar. 12, 2005

(65) Prior Publication Data

US 2006/0225813 A1 Oct. 12, 2006

(51) Int. Cl.
*B27M 3/00* (2006.01)

(52) U.S. Cl. ..... 144/27; 408/26

(58) Field of Classification Search ..... 144/1.1, 144/3.1, 27, 653, 2.1, 286.5; 408/26, 49; 409/201, 216

See application file for complete search history.

(56) References Cited

U.S. PATENT DOCUMENTS

| | | | | |
|---|---|---|---|---|
| 3,339,601 | A * | 9/1967 | Christman et al. | 144/3.1 |
| 4,485,857 | A * | 12/1984 | Norlie et al. | 144/424 |
| 5,222,290 | A | 6/1993 | Kvalheim | |
| 6,561,238 | B2 * | 5/2003 | Knighten | 144/385 |

* cited by examiner

*Primary Examiner*—Shelley Self
(74) *Attorney, Agent, or Firm*—Corwin R. Horton

(57) ABSTRACT

A workstation having an assembly that includes a support for holding a jamb positioned with the face thereof at a site for mortising a hinge pocket in the face, a support for receiving and holding a door with its hinge side edge at the site adjacent to and parallel with the jamb for mortising operations at that edge and a cutting tool carried by the assembly operating to form hinge mortises in an edge of the door and the jamb face at the site. The support for the door is operable to pivot the door about the hinge side edge of the door from a first angle for forming hinge mortises in the hinge edge of a door having a bevel and a second angle for forming hinge mortises in the hinge edge of a door having no bevel.

10 Claims, 9 Drawing Sheets

WORKSTATION FOR PREPARING DOOR ELEMENTS FOR HANGING

BACKGROUND OF THE INVENTION

This invention relates to the manufacture of door units for installation in building constructions. Doors together with their frames are typically delivered as a unit to the construction site in partial or completely prefabricated form. Such Units are referred to as "prehung" doors and they comprise a door and a doorframe, The doorframe, in turn, comprises a door jamb at either vertical side of the door and a header, the horizontal member above the door connecting the two jambs.

Hinges attach the door to one of the jambs (the hinge jamb) for opening and closing the door. The other vertical jamb is referred to as the strike jamb, as it receives the bolt on the door latch for closing and locking the door. Doors units are made to be either right opening or left opening, as needed. Left opening doors will have their hinges and hinge jamb on the right and right opening doors will have their hinges and hinge jamb on the left. Hinges and other door hardware will be placed accordingly Two or three hinges are normally applied, spaced apart along the door side edge and jamb margin. Hinges for doors typically are butt hinges which comprise two flanges or leaves that are joined together at adjacent margins with a pin extending along the margins from the top of the flanges to the bottom to form the hinge joint. The flanges are for seating on the receiving surfaces of the door and jamb. Typically, the receiving surfaces are prepared by routing out a pocket for each flange to a depth that the outer surface of each flange is flush with the adjacent door and jamb surface.

The hinge flanges are each provided with holes therethrough for receiving screws to fix the hinge flanges to the door margin on one side and the jamb face on the other, with the hinge pin therebetween. When the hinge is closed, bringing the two flanges together, the hinge joint with its pin extends along one side of the hinge. The hinges are mounted with their pin sides to the same side of the door (the pin side) with the door edges seated so that the door may thus be opened toward the pin side.

Earlier, both of the side edges of doors had a generally flat surface that extended perpendicularly to the door face (referred to here as "square edges"). More recently manufacturers have beveled the side margin of the door on one side, the side intended to be the latch side. This bevel is typically at about three degrees inward in the direction of closing the door. This bevel is for the purpose of insuring adequate clearance between the door edge and jamb as the door is closed. However, if the door unit fabricator wishes to be able to produce units which are either left or right opening two inventories of doors must be carried, one of doors with a right side bevel and the other with a left side bevel.

To alleviate this problem, many door manufacturers now produce doors that are beveled on both side edges so that they may be used to produce either right or left opening doors, as desired. However, this, in turn, has created another problem in manufacturing the door units with the automatic equipment currently in use, as will be described.

Door units are fabricated using automated workstations, which prepare the side edge of the door and the face of a jamb for applying hinges. U.S. Pat. No. 5,222,290 of the present inventor describes one example of such a workstation. At these workstations pockets are formed in the door and door jambs for the hinges. Additionally, the workstation may have automated equipment for applying hinges on the door and door jambs at the thus prepared surfaces. The workstations are adapted to receive and hold rigidly a door, usually with the door face generally horizontally disposed, with a leading side edge of the door at a station for mortising to form hinge pockets. A door jamb is held at that location with its side edge generally parallel with the leading door side edge and with the jamb face flush with the leading side edge of the door. The jamb face and the surface of the door edge are thus essentially coplaner and thereby establish a work plane for carrying out the pocket milling operation on both the door edge and the jamb face at that location.

Typically, such workstations have one or more routers that may be moved to confront desired hinge sites along the adjacent door side edge and jamb face and to mill out the hinge pockets on the surface of the door side edge and on the jamb face at the work plane. The routers are oriented to mill the surfaces in a plane parallel with the work plane at the jamb face and the surface of the door side edge. In this manner pockets can be formed that receive the hinge flanges with the upper surfaces of the flanges flush with the jamb face and the door side edge surface.

The workstation may also have associated equipment to apply a hinge to the thus prepared hinge site at the work plane following the router operation. Screws are supplied to the screw hole sites by this equipment and automatic screwdrivers are applied to drive the screws perpendicularly to the work plane.

The foregoing equipment and procedure may be applied with good results to the traditional door edges that are not beveled, i.e. they are square, (perpendicular to the door faces). However, if the door edge is beveled, the hinge pocket will still be milled perpendicularly to the work plane, not parallel to the beveled surface. The result is that the hinge flange applied to the beveled edge of the door is, in turn, not parallel with the bevel. Consequently, the hinge flange will not be flush with the beveled surface, but, rather, partly exposed, above the beveled surface. This exposure detracts from the appearance of the door unit and may to some degree impair the attachment of the hinge to the door.

In one attempt to at least partially remedy this defect. The router is reoriented to mill at an angle that is half way between the work plane and the angle of the bevel. This compromise reduces, but does not eliminate, the exposure of the door hinge flange beyond the edge surface. And as a consequence, since milling is no longer parallel with the jamb surface, the hinge flange at the jamb face now will be partially exposed as well.

Another approach regarding this problem is that described in U.S. Pat. No. 6,561,238. A door processing machine is provided with a large tiltable section that bears a router for forming hinge pockets and the support structure for holding a jamb with its face in position for milling by the router. This section is supported by a single pivot bar extending the length of the machine parallel to the leading side edge of the door. If the leading edge of the door is square, the tiltable section is pivoted relatively to the door to bring the router into confrontation with that edge to mill it parallel with the surface of the door edge. With that positioning the router may mill parallel to both the surface of the door edge and the jamb face to produce the hinge pocket. If the leading door edge is beveled, the tiltable section may be pivoted to bring the router borne by it to an angle to mill the door edge surface parallel with that surface. The hinge pocket may thus be milled to a uniform depth to completely receive the hinge leaf with its surface flush with the door edge surface. Since the jamb is borne by the tiltable section, it will also tilt so its face is in confrontation with router at either positioning.

While with the forgoing arrangement hinge pockets parallel with the jamb face and door edge surfaces may be milled, there are significant disadvantages with this approach. It requires a radical departure from the normal workstation design. A large section of the workstation, including frame, is mounted for rotation on a single long bar. This section must not only bear the mortising assemblies but any additional equipment for operating on the juxtaposed door edge and jamb, such as a hinge applicator, including its, hinge storage and delivery equipment, screw dispenser and multiple automatic screwdrivers. Additionally this pivoting section must bear the jamb and its support equipment. Besides the complexity of this design, there can be a substantial risk that one or more of these work un-its can become misaligned due to the heavy equipment borne by this suspended section. A simpler, less expensive and more straightforward and reliable approach is needed.

SUMMARY OF THE INVENTION

This invention relates to a procedure and apparatus for automatically preparing hinge pockets in a door side edge and an adjacent jamb face that are satisfactory for hinging either a bevel edge or a square edge of a door to a door jamb. In this invention conventional equipment designed for forming hinge pockets in a square door edge and a door jamb face may be employed. Such workstations have an assembly for machining hinge pockets, including a cutting tool moveable to a workplane, the position where the tool or cutter comes into contact with the door edge, for cutting into surfaces located at the workplane to form hinge pockets that are parallel with the workplane. The cutting tool cuts in a plane parallel to the workplane and perpendicular to the forward direction of movement of the cutting tool. Normally, the cutting tool cuts a surface in a transverse routing path in its direction of travel, beginning at the workplane, for a distance equal to thickness of the hinge leaves. Such workstations have a support for holding a door with a leading side edge of the door at the workplane and another support for holding a door jamb with its side edge generally parallel with the leading door side, with the jamb face flush with the leading side edge of the door and with the jamb face and the surface of the door edge in the workplane.

In conventional workstations, the support for the door is fixed and presents the leading side edge of the door at the workplane with the face of the door perpendicular to the workplane. In contrast, as an important feature of this invention the support for the door is provided with the capability of tipping the door about the leading edge of the door between a position that holds the face of the door perpendicular to workplane to a position at which the beveled surface of a beveled side edge of beveled door is in the workplane.

In another feature of the invention, the hinge pocket routers and other equipment operating at the jamb and door edge may be fixed in positions to provide a workplane therefor that is inclined at an angle from the vertical away from the door edge, and particularly at an angle equal to the angle of the door edge bevel or greater. The support for the jamb is arranged to support the jamb with its face in the thus inclined workplane. In this configuration the door support positions the door with its face horizontal or higher for a beveled door and at a yet higher angle for a square edge door. Preferably the workplane is inclined at an angle equal to the angle of the door edge bevel and the door support supports the door to the horizontal plane. The foregoing configuration avoids the difficulty of modifying the workstation to permit positioning the door below the horizontal.

In another feature of this invention, the workstation further includes an automatic door hinger, comprising an applicator for receiving a hinge with its leaves open, for receiving screws in position for driving through openings in the hinge leaves and for applying, at the workplane, the hinge together with the screws, with one hinge leaf at a hinge pocket in the door edge and the other leaf at a hinge pocket in an adjacent jamb face, a screw feeder for feeding screws to the applicator individually for each opening in the hinge leaves and a battery of automatic screwdrivers oriented for driving the screws through the hinge openings into the door edge and jamb face perpendicularly to the workplane.

In another feature of the invention the workstation is provided with a fixed frame that supports the hinge pocket router modules, the jamb and a tilt frame that support the door with its side edge at the workplane and tilts the door between a position at one angle for a beveled door and another angle for a square edged door.

In another feature the tilt frame supports a latch side module for machining the latch side so that the module may machine the latch side with the door tilted at an angle for either a square edge or for a bevel edge door.

DETAILED DESCRIPTION OF THE PREFERRED EMBODIMENT

The following description illustrates the manner in which the principles of the invention are applied but is not to be construed as limiting the scope of the invention.

The workstations of this invention are intended for preparing doors and jambs for hinging by mortising hinge pockets in both the door edge and a jamb face. They may also be used for preparing the door for application of other door hardware, including latches and bolts. For mortising the hinge pockets, mortising modules are stationed at the hinge sites along the door edge. Alternatively, a single mortising unit may be employed for all of the hinge sites, by mounting the mortising unit on a carriage that traverses the length of the door edge, stopping at each hinge site to create hinge pockets in the door edge and jamb face at that site.

The workstations may also advantageously incorporate automatic hingers for application of hinges in the same operation. For this purpose they may be mounted for operation at stationary site or on a carriage or the like for movement together with screw driving equipment to screw driving locations. For such a workstation, the hinger may be mounted on a carriage with associated machinery to traverse to the hinge sites along the door edge for applying hinges to doors and door jambs at those sites, as described in my U.S. Pat. No. 5,222,290. The carriage moves on rails along the door edge to hinge locations carrying the automatic hinger, including a hinge applicator, screw feeder, hinge feeder and automatic screwdrivers.

Figure 1:
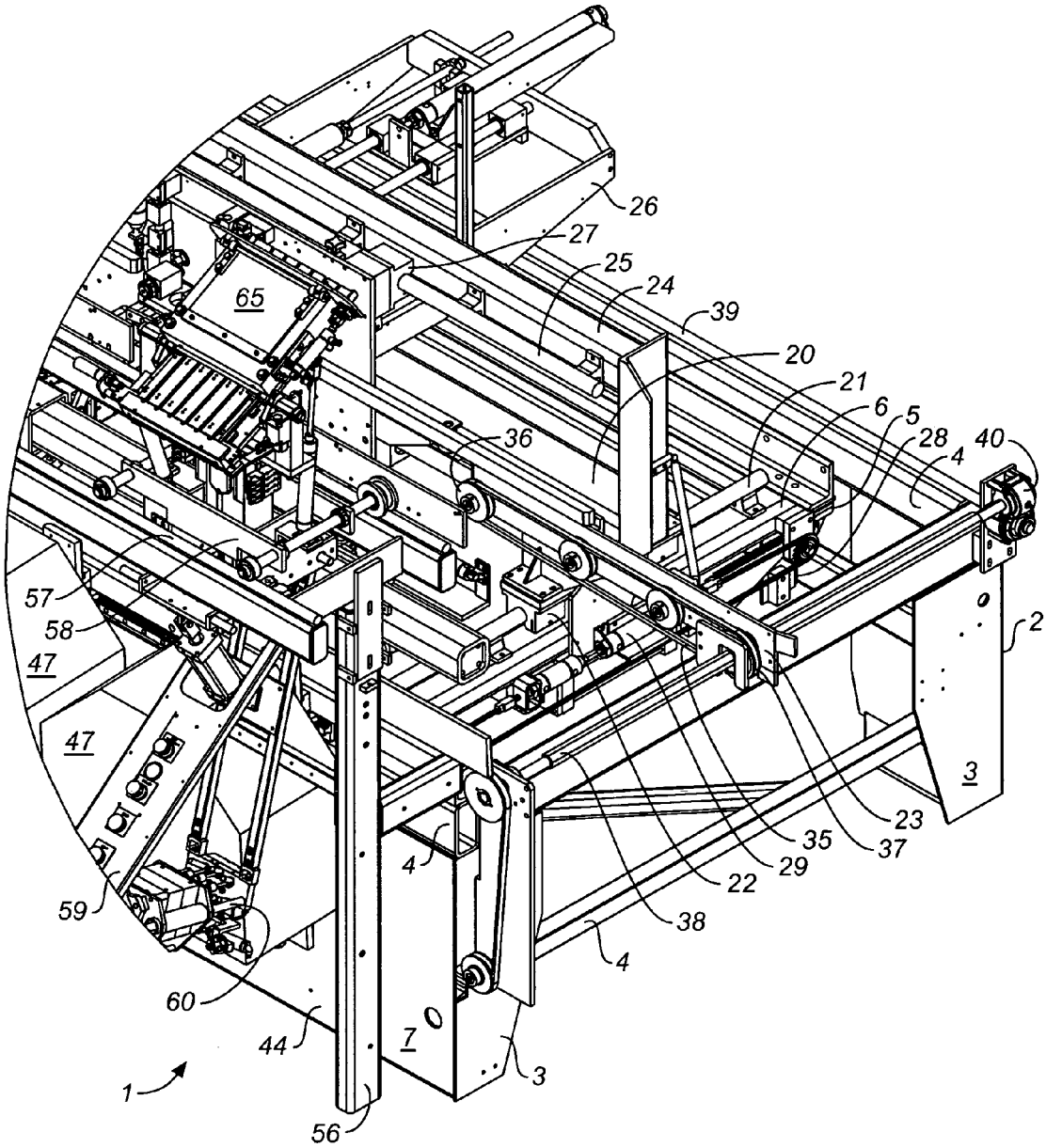
FIG. 1 is an isometric partial view of an embodiment of the workstation of the present invention, taken from the front side of workstation at the outfeed end.
Figure 2:
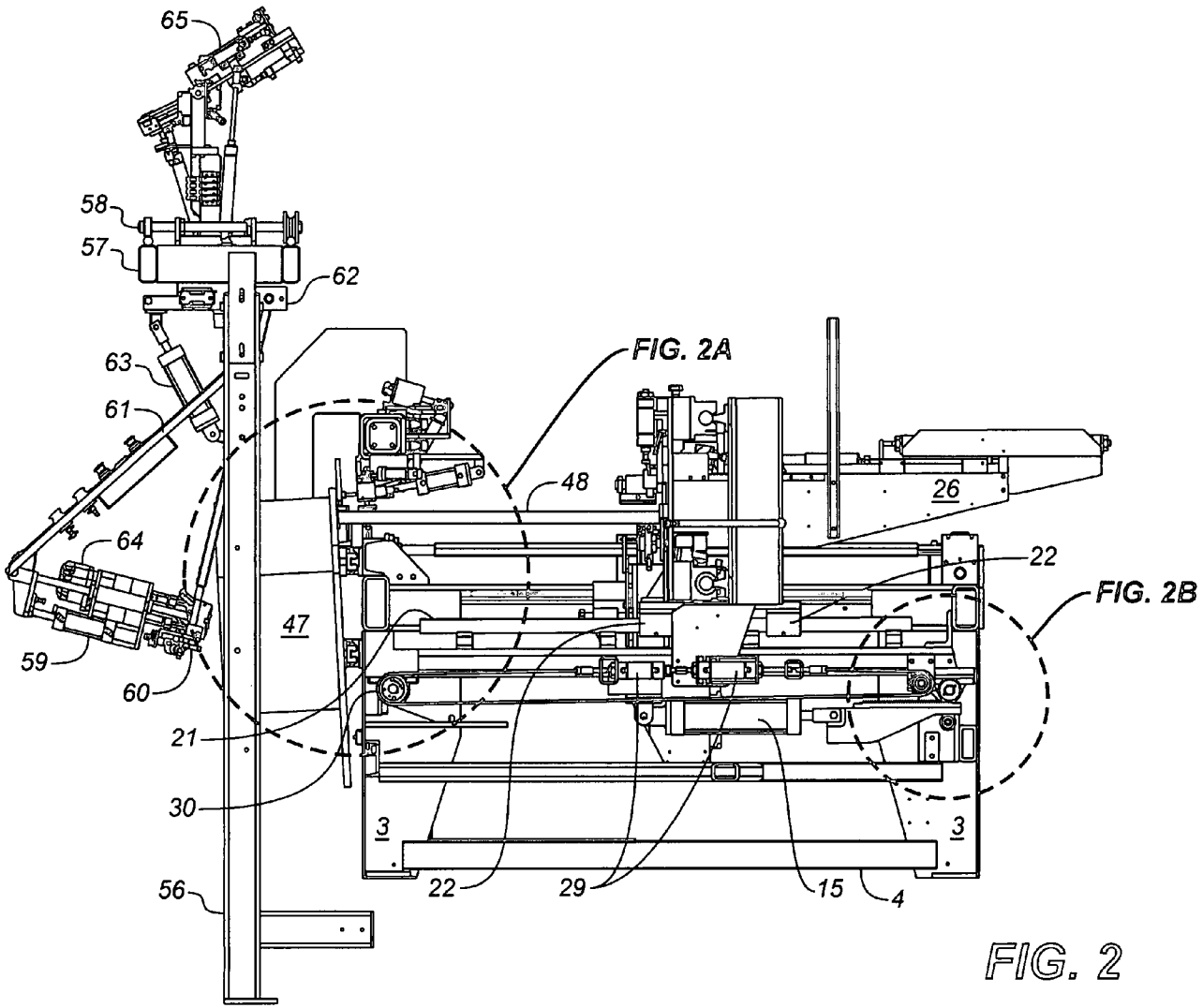
FIG. 2 is a is plan view of the outfeed end of the workstation of FIG. 1 with the door support in its lowered position 1.
Figure 4:
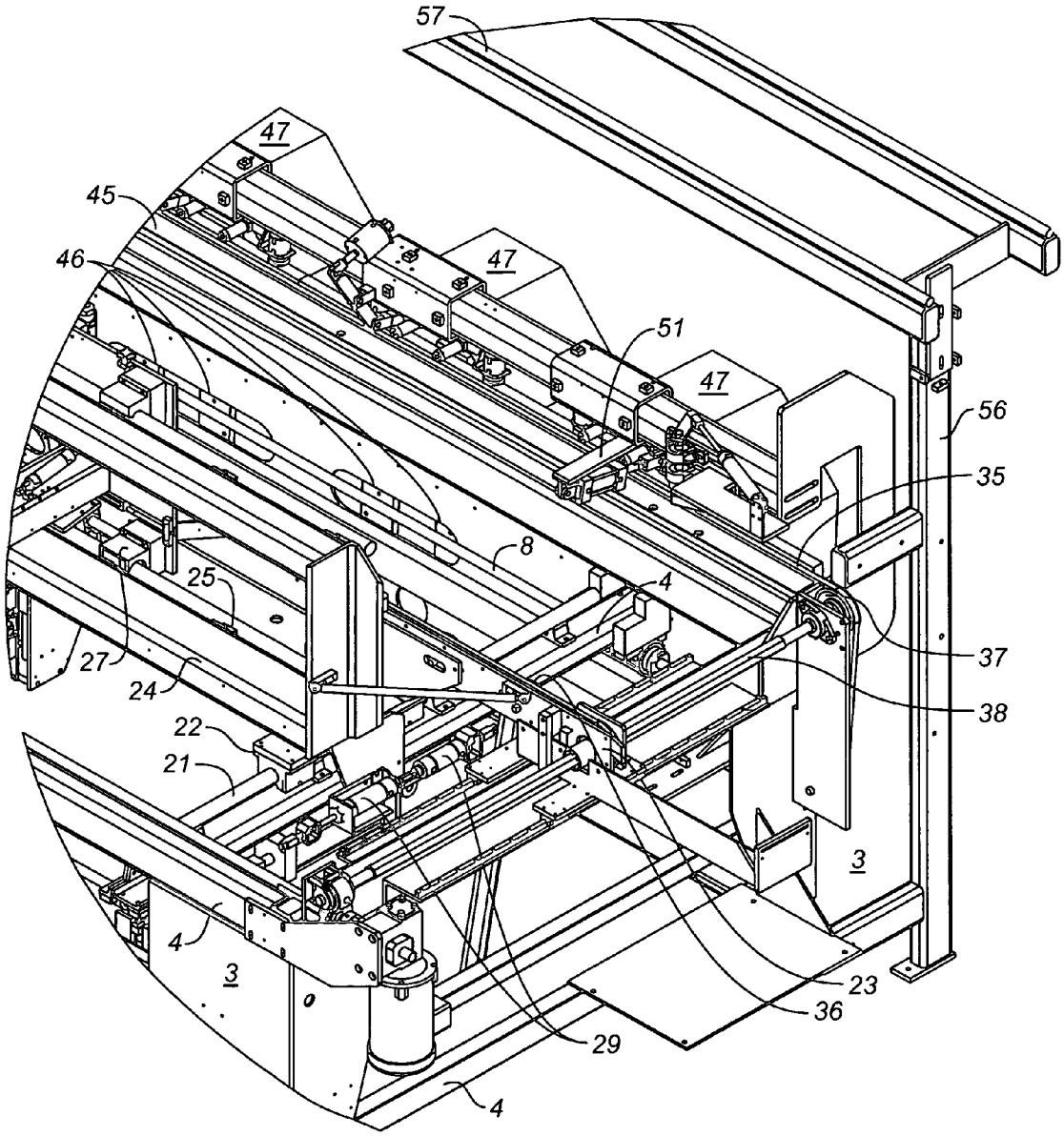
FIG. 4 is an isometric partial view of the workstation of FIG. taken from the rear side of workstation at the infeed end 1.
Figure 5:
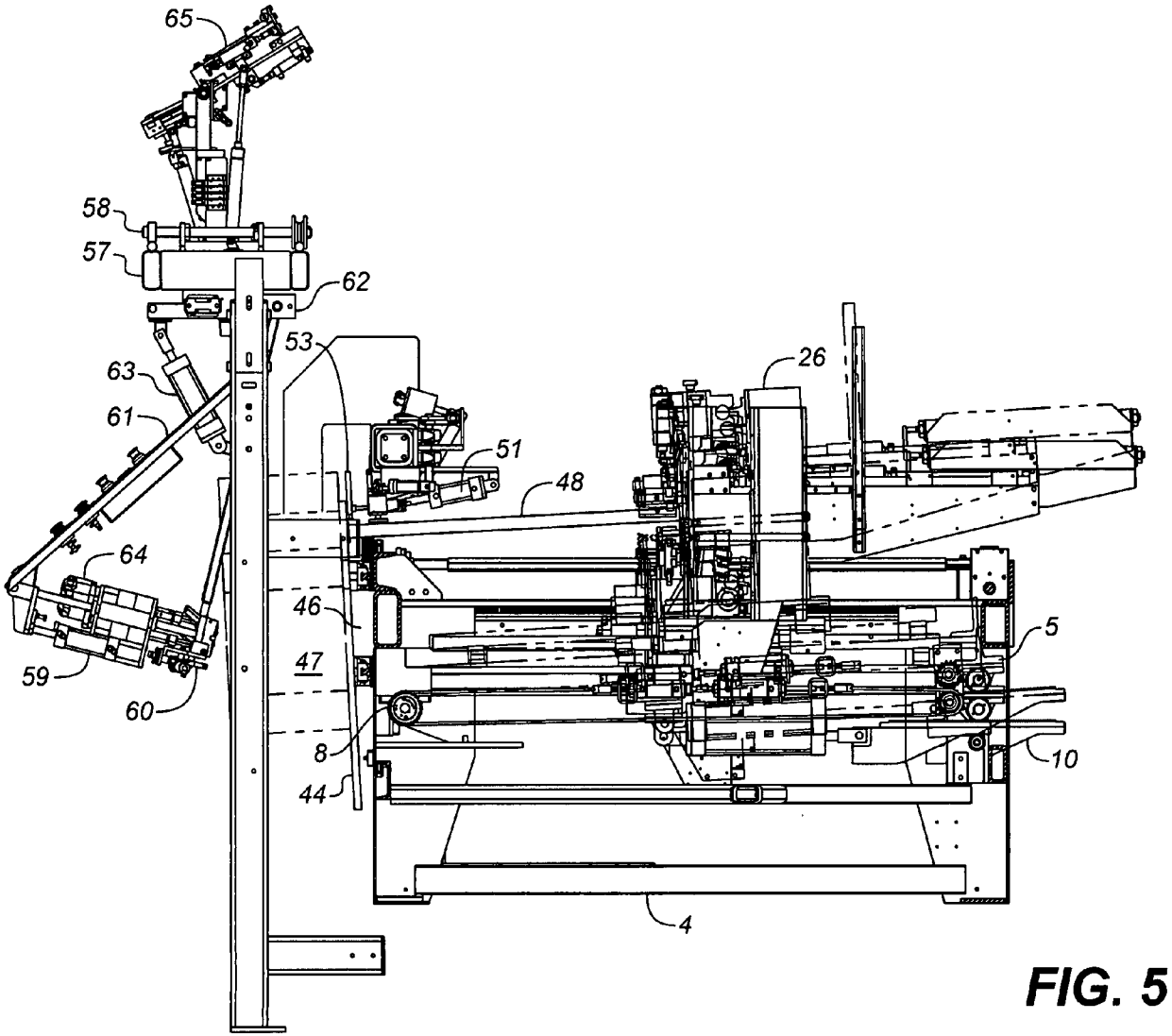
FIG. 5 is a plan view of the outfeed end of the workstation of FIG. 2 showing the door support in its lowered position in bold lines and in the raised position dotted lines.
Figure 6:
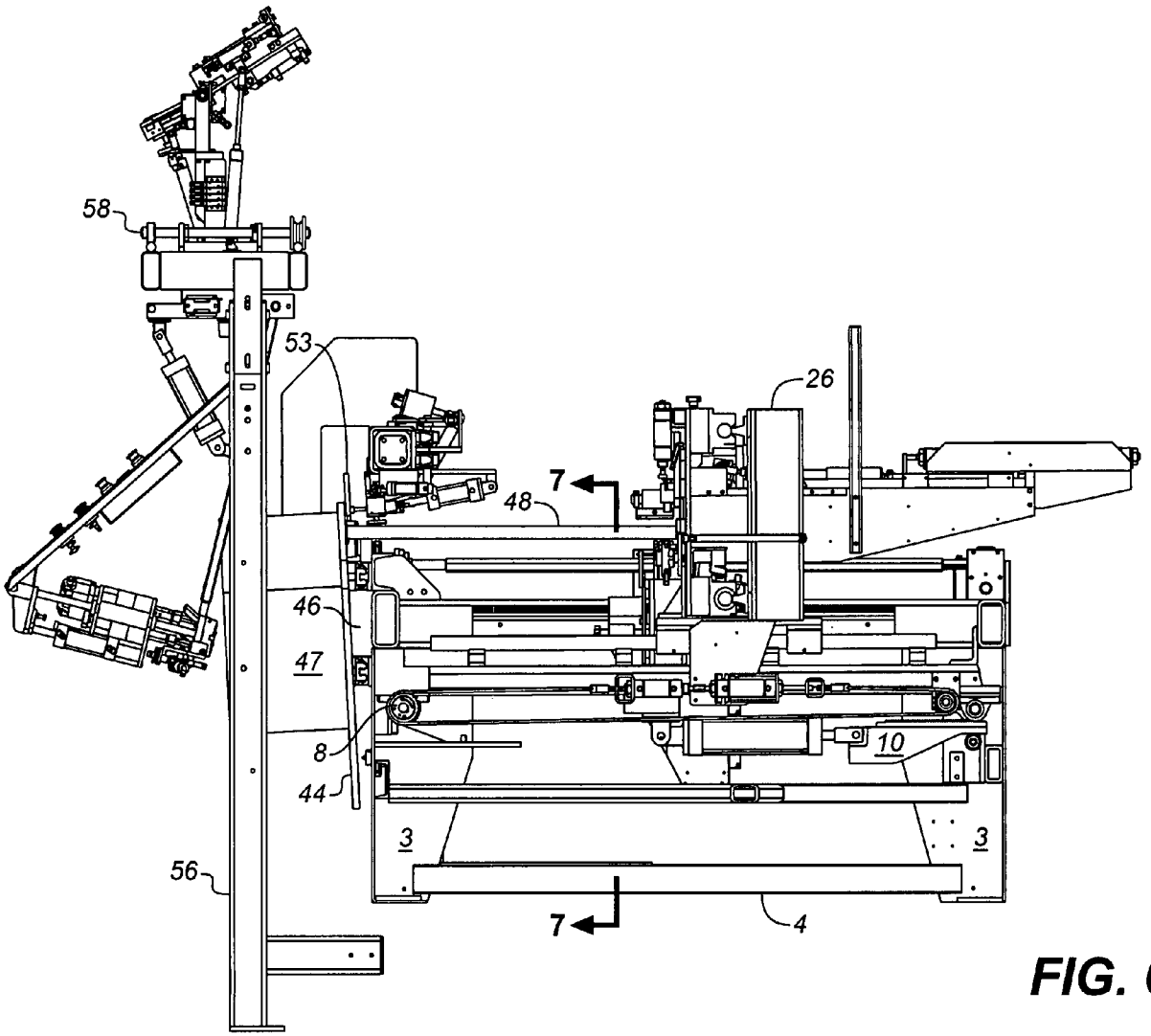
FIG. 6 is a plan view of the outfeed end of the workstation of FIG. 2 showing section lines 6A-6A.
Figure 7:
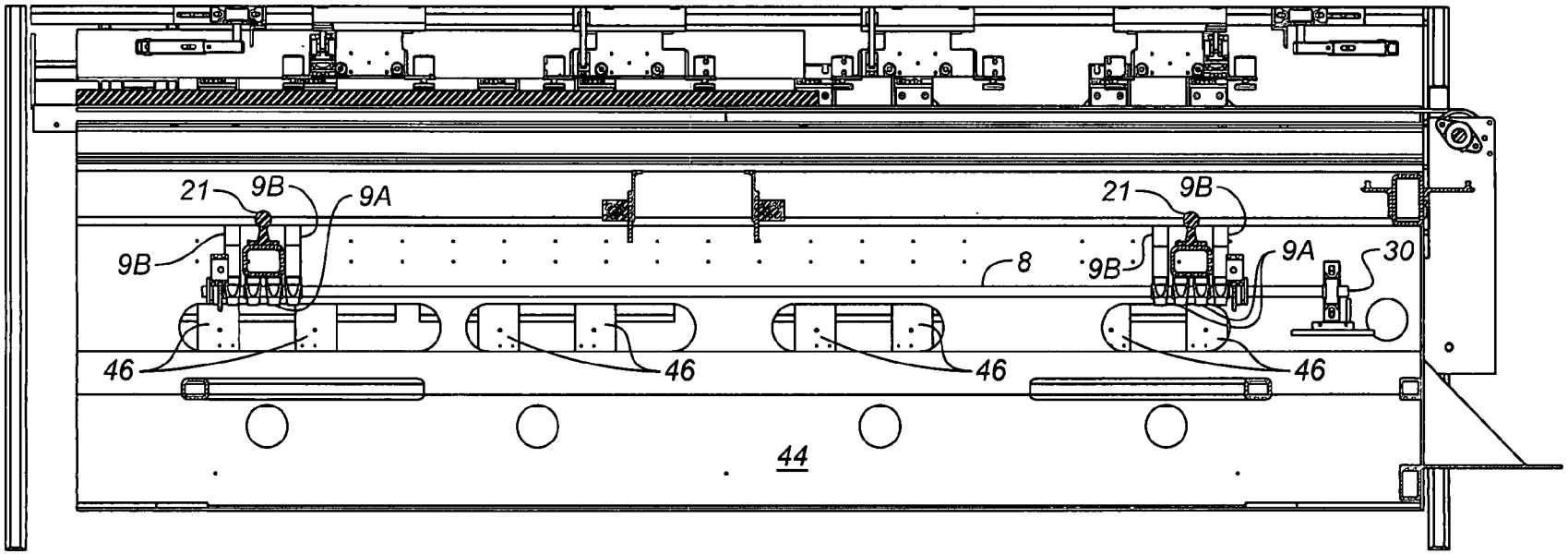
FIG. 7 is a is cross-sectional plan view taken along lines 6A-6A of FIG. 6, showing pivot details.

Referring to the drawings, particularly to FIGS. 1, 2, and 4, a workstation 1 is shown having a frame 2 comprised of corner uprights 3 at the outfeed end, as shown in FIG. 1, and at the opposite (infeed) end of the workstation (shown in FIG. 4) and lateral beams 4 connecting and supporting all four uprights 3. Pivot frame 5 is comprised of beams 6 and is carried by frame 2 as follows. Referring to FIG. 6 and 7, pivot shaft 8 extends along, the front side 7 of workstation 1 at the inside of frame 2 and is spaced a small distance from and attached to beam 4 at side 7 by mounting bearings 9A permit rotation of shaft 8. At either end of front side 7 one end of a beam 6 of pivoting frame 5 is attached to mounting bearings 9B for pivoting frame 5 about pivot shaft 8.

At each rear corner of frame 5 at the back of workstation 1, frame 5 is supported for tilting between a lower position and an elevated position by cam 10 having a rack along a horizontal upper surface. A gear wheel 11 is mounted on a projection from a beam 6 to mesh with cam 10 and be supported by cam 10. Cam 10 has an inclined lower cam surface 12 that is borne by support wheel 13 that is rotatably mounted on a plate 14 projecting from and attached to beam 4. Thus cam 10 is supported by support wheel 13 and, in turn, supports gear wheel 11 and thereby frame 5.

When cam 10 is at its rear position the pivoting frame 5 is at its lower position bringing a door resting on top of frame 5 to a horizontal position. When cam 10 is at its forward position the pivoting frame 5 is at a raised position about its pivot at pivot shaft 8 bringing a door resting on top of frame 5 to a tilted position above the horizontal. Air cylinder 15 is secured to beam 6 at the forward end and its piston 16 is attached to the rear end of cam 10 for urging it between the rear position and the forward position.

Mounted on pivoting frame 5 is carriage 20 borne by a support tube 21 toward the outfeed end of workstation 1 and another support tube 21 toward the infeed end. Tubes 21 are secured to and extend from beam 6 at the back side of frame 5 to beam 6 at the front side of frame 5, to which they are also secured. Sleeves 22 attached to carriage 20 slidably engage tubes 21 for movement of carriage 20 along tubes 21 toward and away from the front of workstation 1. Carriage 20 bears door edge clamp member 23 as will be discussed. Carriage 20 also has a support frame 24 that includes two tubes 25 in the door feed direction. A striker side machining module 26 is slidably mounted on tubes 21 by sleeves 27 for lateral movement in the feed direction for adjusting its positioning for machining the striker side latch hole, bolt hole and latch mortise.

A circular pull chain 28 is provided at both the infeed and outfeed sides of carriage 20 for adjusting its position toward and away from the front side of workstation 1 to accommodate doors of different widths. Pull chains 28 are fixed to carriage 20 at respective tension control cylinders 29, Each chain 28 is looped around a sprocket wheel 30 rotatably held by beam 6 toward the front of workstation 1 and a sprocket wheel 31 held by a beam 6 toward the rear of workstation 1. Sprockets 30 are both fixed to rotatable shaft 8 and turn with it. When shaft 8 rotates, both chains 28 are urged in the same direction to move carriage 20 either toward or away from the front of the workstation. A motor (not shown) rotates shaft 8.

Conveyor belts 35 at both the infeed and outfeed ends of the workstation are adjacent door edge clamp 23 at the rear edge of the door path through the workstation and held by slave pulleys 36 and a drive pulley 37. Each drive pulley 37 is sidably mounted along and driven by a respective hexagonal drive shaft 38. The respective drive shafts 38 are power interconnected through a hexagonal drive shaft 39 along the rear side of the workstation by means of transmission gears 40 at the respective junctions of drive shafts 38 and drive shaft 39. A motor (not shown) rotates drive shaft 39 to thereby drive both conveyor belts 35.

Figure 2C:
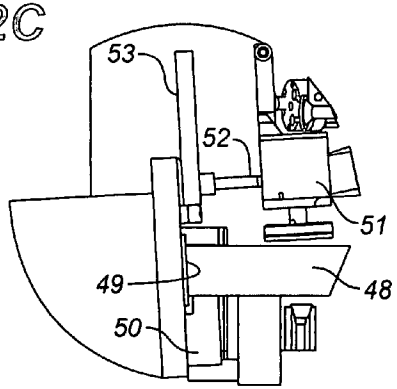
FIG. 2C is a blown-up fragmentary view taken of the circular portion indicated by the connecting line of the plan view of FIG. 2 of the workstation of FIGS. 1 and 2 showing further details of the front side of the workstation at the outfeed end.
Figure 2B:
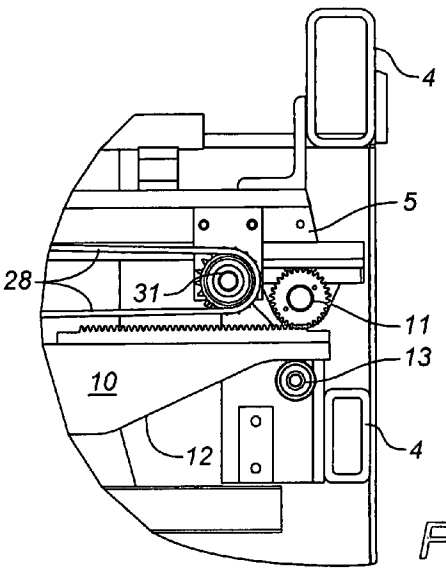
FIG. 2B is a blown-up fragmentary view taken of circular portion indicated by the connecting line of the plan view of FIG. 2 of the workstation of FIGS. 1 and 2;, showing details of the rear side of the workstation at the outfeed end.
Figure 2A:
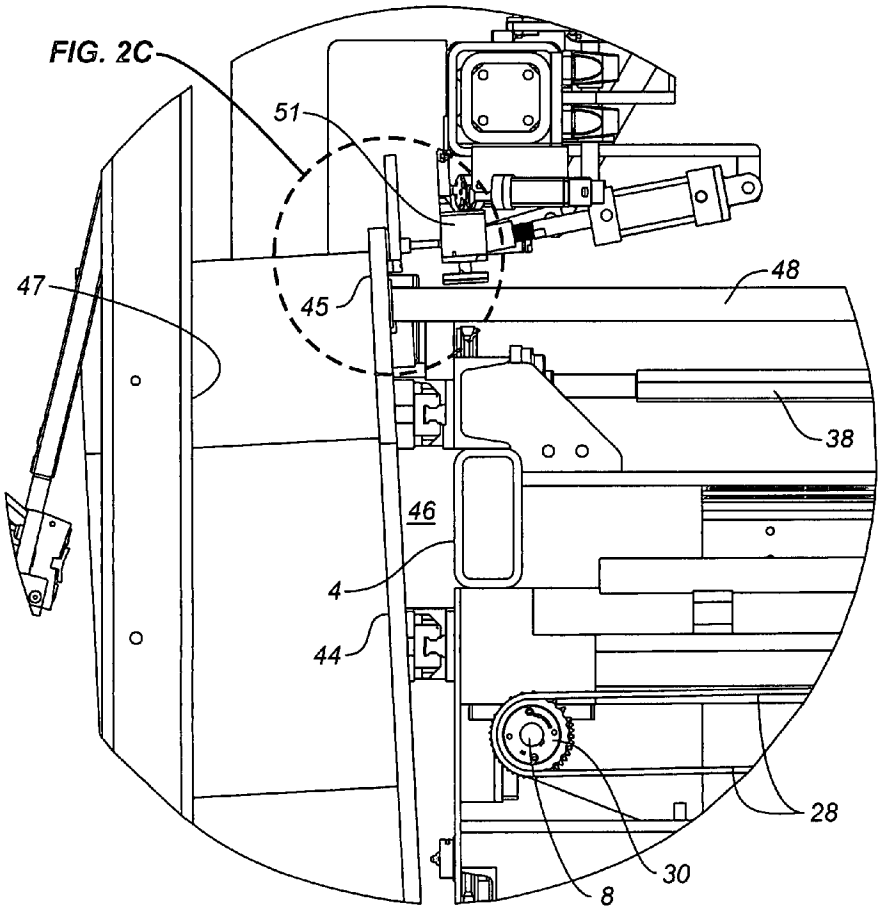
FIG. 2A is a blown-up fragmentary view taken of the circular portion indicated by the connecting line of the plan view of FIG. 2 of the workstation of FIGS. 1 and 2 showing details of the front side of the workstation at the outfeed end.

As seen particularly in FIGS. 2A the front side 7 of the workstation is sidewall 44, the top portion 45 of which serves as a door edge clamp and a jamb clamp. Behind sidewall 44 are "H" shaped blocks 46 that act to reinforce and to bring sidewall 44 and clamp portion 45 to the proper angle to set the workplane for routers and other work elements operating at the workplane. H blocks 46 are tapered with a decreasing thickness toward the bottom of frame 2. Frame 2 is rectilinear and beams 4 at the front of the workstation are in the same vertical plane. H blocks, which are attached to the front side beams 4, are tapered by an amount to bring sidewall 44 and door edge and jamb clamp 45 to an angle from the vertical toward the front of the workstation equal to the angle of the bevel of doors to be processed on the workstation. Currently, the standard for bevel door is a three degree bevel. Thus, in this embodiment, the H blocks are tapered at a three degree angle to bring sidewall 44 and clamp member 45 to an angle of three degrees from the vertical.

Referring particularly to FIGS. 1, 2A, 3A, 4 and 5, router modules 47 are secured against the outside of sidewall 44 at hinge sites along a door edge 49 of a door 48 on the workstation. The workplanes of their cutting tools are thus parallel to sidewall 44 and at a three degree angle from the vertical. At each of these sites there is a gap in sidewall 44 and in H blocks 46 to provide clearance for operation of routers and other work equipment at those sites. As shown in phantom lines in FIG. 5, router modules 47 are movable between a position confronting the door edge and a position confronting the jamb face to mortise both the door edge and the jamb face. At either position they maintain their parallelism with sidewall 44 their workplane remains at three degrees from the vertical.

Door edge 49 is held against clamp member 45 at sidewall 44 by edge clamp member 23 acting from the latch side edge of door 48 and supported from below by edge rest 50.

Figure 3:
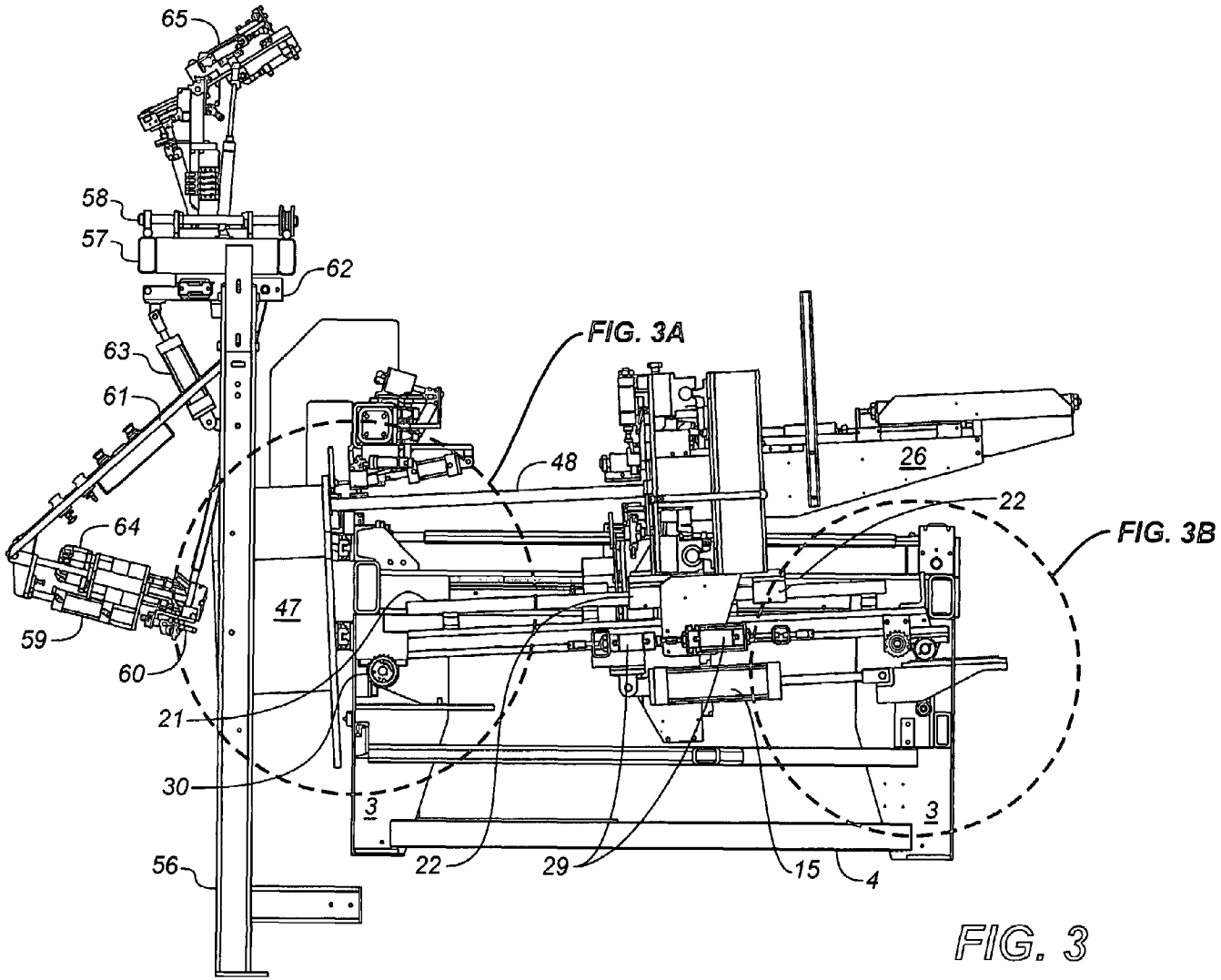
FIG. 3 is a is the same cross-sectional view as in FIG. 2 with the door support in its elevated position.
Figure 3C:
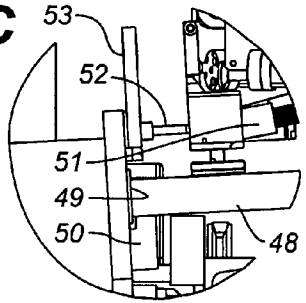
FIG. 3C is a blown-up fragmentary view taken of circular portion indicated by the connecting line of the plan view of FIG. 3 of the workstation of FIGS. 1 and 2 showing details as in FIG. 2C.
Figure 3B:
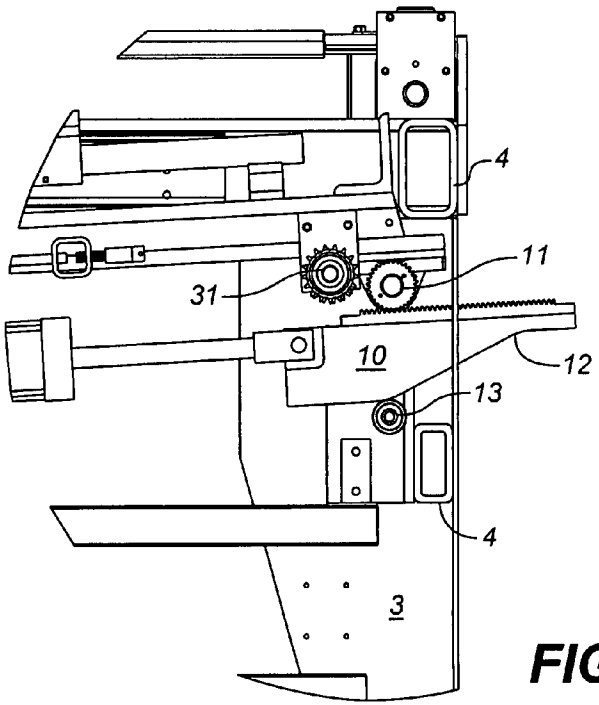
FIG. 3B is a blown-up fragmentary view taken of circular portion indicated by the connecting line of the plan view of FIG. 3 of the workstation of FIGS. 1 and 2 showing details as in FIG. 2B.
Figure 3A:
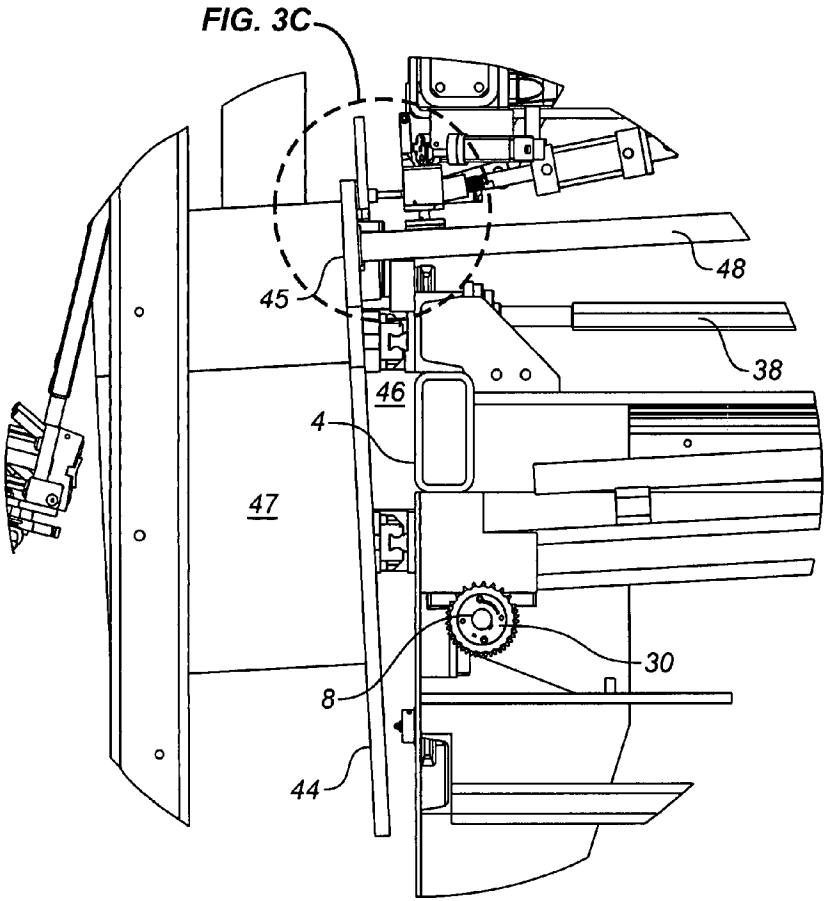
FIG. 3A is a blown-up fragmentary view taken of circular portion indicated by the connecting line of the plan view of FIG. 3 of the workstation of FIGS. 1 and 2 showing details as in FIG. 2A.

As seen particularly in FIG. 2C and 3C, a jamb clamp 51 is at either end of jamb and has a piston 52 that projects to clamp the jamb 53 against the clamp member portion 45 of sidewall 44. This brings the face 54 of jamb 53 into the workplane established by router modules 47. The clamps 51 hold jamb at a spacing from door edge 49 appropriate to accommodate an open hinge therebetween along the work plane, with one flange at the face of the jamb and the other at the door side.

Uprights 56 extend vertically at both front ends of the workstation. and carry carriage track 57 extending between uprights 56. Uprights are attached to stationary frame 2 of the workstation. Carriage 58 rides along the front of the workstation on track 57 and carries with it the automatic hinge applicator module 59. Hinge and screw applicator 60 is suspended below carriage 58 on swing 61 that is attached to carriage 58 by a pivot connection 62. Hinge and screw applicator swings about pivot connection 62 between a retracted position and an engaged position adjacent sidewall 44, impelled by air cylinder 63. Track 57 is spaced outwardly from the sidewall 44 at the front of the workstation to a position that brings pivot 62 on carriage into the same plane as the inner side of sidewall 44. With pivot 62 so positioned hinge and screw applicator at its engaged position the face of hinge and screw applicator 60 will be parallel with sidewall 44 and in the workplane with the jamb face 54 and door edge 49 for applying a hinge. At that position the bits of automatic screwdrivers 64 carried on applicator 60 will also be perpendicular to the workplane to properly drive the screws. Screw dispenser 65 is also mounted on carriage 58 to collate screws and supply individually to applicator 60 for each screw opening in the hinge through a plastic tube from the dispenser for each (not shown).

Before a door is fed at the workstation infeed, if the door is a different width from that last processed, chain 28 is activated to move carriage 20 toward or away from the edge clamp 45 an appropriate distance to accommodate the new door. If the door is beveled and the last door with a square edge, or vice versa, air cylinder 15 is activated to either move the cam to the rear or forward, as appropriate. With the cam forward, the workstation is set for processing a square edge door. With the cam at its rear position, the door will be in a horizontal position for processing a door having a beveled side edge.

The invention claimed is:

1. A workstation suitable for processing a jamb having a face along a longitudinal side of the jamb and a door having a longitudinal hinge receiving side edge and an opposed latch receiving side edge, the hinge receiving side edge being for receiving at least one butt hinge having a pair of hinge leaves, one of the leaves to be applied to the door edge and the other leaf to an adjacent jamb face and the workstation being suitable for selectively processing a door having either a square or beveled hinge receiving side edge which comprises:

a. structure for supporting a door and a jamb for processing and for supporting equipment for processing the door edge and jamb face;

b. at least one butt router supported on the structure, the router having a rotatable cutter that routs about a rotational axis and is capable of routing in a forward direction of the cutter axis of rotation and transversely of the cutter axis of rotation, the router being positioned to rout in the forward direction of the cutter rotational axis from a preselected routing contact position and transversely to the forward direction, the router being provided with means for moving the router cutter on a routing path transverse to the router cutter rotational axis for forming mortises along the path;

c. means operably positioned on the structure relative to the butt router for holding the jamb with the jamb face at the routing contact position confronting, coplanar with and extending along the router transverse routing path; and d. means operably positioned on the structure relative to the butt router for holding a door with a hinge receiving side edge adjacent to the jamb and at the routing contact position confronting, coplanar with and extending along the router transverse routing path, the door holding means being adapted to hold the door at a first angle about the hinge side edge, for forming hinge mortises in the hinge edge of a door having a bevel, and at which the beveled edge is coplanar with the router transverse routing path, and, alternatively, at a second angle about the hinge side edge, for forming hinge mortises in the hinge edge of a door having a square edge, and at which the square edge is coplanar with the router transverse routing path.

2. A workstation as in claim 1 and wherein the support structure comprises a stationary framework that supports the router and the means for holding the jamb face and wherein the means for holding the door comprises a pivotable framework, the pivotable framework having a pivot that is supported on the support structure and has a pivot axis adjacent to and extending along the transverse path of the router cutter.

3. A workstation as in claim 1 and wherein the first angle is approximately 3 degrees from the second angle.

4. A workstation as in claim 1 and wherein the workstation includes an automatic door hinger on the structure in a position operable to apply, at the transverse routing path at the routing contact position, a butt hinge between the jamb face and the door edge, with one hinge leaf at a hinge pocket in the door edge and the other leaf at a hinge pocket in the adjacent jamb face.

5. A workstation as in claim 4 and wherein the door hinger comprises an applicator mounted on the structure for movement between a retracted position spaced from the router transverse routing path at the router contact position and an engaged position at the router transverse routing path at the router contact position operable to receive, at the retracted position, a butt hinge with the hinge leaves open, to receive, at the engaged position, screws in position for driving through openings in the hinge leaves and to apply, to a door edge and jamb face held at the transverse routing path at the routing contact position, the hinge together with the screws, with one hinge leaf at a hinge pocket in the door edge and the other leaf at a hinge pocket in an adjacent jamb face, a screw feeder for feeding screws to the applicator individually for each opening in the hinge leaves and a battery of automatic screwdrivers mounted on the structure and movable from a retracted position to a position to drive the screws through the hinge openings into the door edge and jamb face perpendicularly to the router transverse routing path.

6. A workstation as in claim 2 and wherein the pivotable frame supports a latch machining module positioned to machine a latch edge and latch hole at the latch side of the door at either pivot angle for the door.

7. A workstation as in claim 1 wherein the support structure comprises a stand having a horizontally disposed base and the structure extends vertically upward from the base and wherein the router is positioned on the structure so that the axis of rotation of the router cutter is at an angle above the horizontal in said forward direction equal to the bevel angle of doors to be processed and the second support is operable to support a beveled door at the horizontal plane with the face of the hinge side edge and, alternatively, to support a square edge door at an angle above the horizontal plane equal to the bevel angle with the face of the hinge side edge at the transverse routing plane.

8. A workstation suitable for processing a jamb having a face along a longitudinal side of the jamb and a door having a longitudinal hinge receiving side edge and an opposed latch receiving side edge, the hinge receiving side edge being for receiving at least one butt hinge having a pair of hinge leaves, one of the leaves to be applied to the door edge and the other leaf to an adjacent jamb face and the workstation being suitable for selectively processing a door having either a square or beveled hinge receiving side edge which comprises:

a. structure for supporting a door and a jamb for processing and for supporting equipment for processing the door edge and jamb face;

b. at least one butt router supported on the structure, the router having a rotatable cutter that routs about a rotational axis and is capable of routing in a forward direction of the cutter axis of rotation and transversely of the cutter axis of rotation, the router being positioned to rout in the forward direction of the cutter rotational axis from a preselected routing contact position and transversely to the forward direction, the router being provided with means for moving the router cutter on a routing path transverse to the router cutter rotational axis for forming mortises along the path;

c. an automatic door hinger on the structure in a position operable to apply, at the transverse routing path at the routing contact position, a butt hinge between the jamb face and the door edge, with one hinge leaf at a hinge pocket in the door edge and the other leaf at a hinge pocket in the adjacent jamb face;

d. means operably positioned on the structure relative to the butt router for holding the jamb with the jamb face at the routing contact position confronting, coplanar with and extending along the router transverse routing path; and e. means operably positioned on the structure relative to the butt router for holding a door with a hinge receiving side edge adjacent to the jamb and at the routing contact position confronting, coplanar with and extending along the router transverse routing path, the door holding means being adapted to hold the door at a first angle about the binge side edge, for forming hinge mortises in the hinge edge of a door having a bevel, and at which the beveled edge is coplanar with the router transverse routing path, and, alternatively, at a second angle about the hinge side edge, for forming hinge mortises in the hinge edge of a door having a square edge, and at which the square edge is coplanar with the router transverse routing path, said door holding means comprising a pivotable framework, the pivotable framework having a pivot that is supported on the support structure and has a pivot axis adjacent to and extending along the transverse path of the router cutter.

9. A workstation as in claim 8 and wherein the first angle is approximately 3 degrees from the second angle.

10. A workstation as in claim 8 and wherein the door hinger comprises an applicator mounted on the structure for movement between a refracted position spaced from the router transverse routing path at the router contact position and an engaged position at the router transverse routing path at the router contact position operable to receive, at the refracted position, a butt hinge with the hinge leaves open, to receive, at the engaged position, screws in position for driving through openings in the hinge leaves and to apply, to a door edge and jamb face held at the transverse routing path at the routing contact position, the hinge together with the screws, with one hinge leaf at a hinge pocket in the door edge and the other leaf at a hinge pocket in an adjacent jamb face, a screw feeder for feeding screws to the applicator individually for each opening in the hinge leaves and a battery of automatic screwdrivers mounted on the structure and movable from a retracted position to a position to drive the screws through the hinge openings into the door edge and jamb face perpendicularly to the router transverse routing path.

* * * * *